US007459251B2

(12) United States Patent
Mishra et al.

(10) Patent No.: US 7,459,251 B2
(45) Date of Patent: Dec. 2, 2008

(54) IMAGING MEMBER

(75) Inventors: Satchidanand Mishra, Webster, NY (US); Kathleen M. Carmichael, Williamson, NY (US); Yuhua Tong, Webster, NY (US); Anthony M. Horgan, Pittsford, NY (US); Edward F. Grabowski, Webster, NY (US); Richard L. Post, Penfield, NY (US); Robert C. U. Yu, Webster, NY (US); Dennis J. Prosser, Walworth, NY (US); Edward Domm, Hilton, NY (US); Min-Hong Fu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 522 days.

(21) Appl. No.: 11/314,484

(22) Filed: Dec. 21, 2005

(65) Prior Publication Data

US 2007/0141491 A1 Jun. 21, 2007

(51) Int. Cl.
*G03G 15/04* (2006.01)

(52) U.S. Cl. ..... 430/64; 430/65; 430/60

(58) Field of Classification Search ..... 430/64, 430/65, 60

See application file for complete search history.

(56) References Cited

U.S. PATENT DOCUMENTS 4,233,384 A 11/1980 Turner et al.
4,265,990 A 5/1981 Stolka et al.
4,286,033 A 8/1981 Neyhart et al.
4,291,110 A 9/1981 Lee
4,299,897 A 11/1981 Stolka et al.
4,306,008 A 12/1981 Pai et al.
4,338,387 A 7/1982 Hewitt
4,439,507 A 3/1984 Pan et al.
4,639,402 A 1/1987 Mishra et al.
4,988,597 A 1/1991 Spiewak et al.
5,215,839 A 6/1993 Yu
5,244,762 A 9/1993 Spiewak et al.
5,378,566 A 1/1995 Yu
5,571,649 A 11/1996 Mishra et al.
5,576,130 A 11/1996 Yu et al.
5,591,554 A 1/1997 Mishra et al.
5,643,702 A 7/1997 Yu
5,703,487 A 12/1997 Mishra
5,830,614 A 11/1998 Pai et al.
6,008,653 A 12/1999 Popovic et al.
6,119,536 A 9/2000 Popovic et al.
6,150,824 A 11/2000 Mishra et al.
6,294,300 B1 9/2001 Carmichael et al.
6,326,111 B1 12/2001 Chambers et al.
6,379,853 B1 4/2002 Lin et al.
6,933,089 B2 8/2005 Horgan et al.

*Primary Examiner*—Mark A Chapman
(74) *Attorney, Agent, or Firm*—Eugene O. Palazzo; Fay Sharpe LLP

(57) ABSTRACT

An imaging member comprising a barrier or under-layer intermediate a photogenerating layer and charge transport layer to reduce charge deficiency spots. The barrier under-layer comprises a film forming polymer binder selected from a conductive polymer binder, a non-conductive polymer binder, or mixtures thereof. Optionally, the barrier layer can include a small amount of a charge transport material.

20 Claims, 1 Drawing Sheet

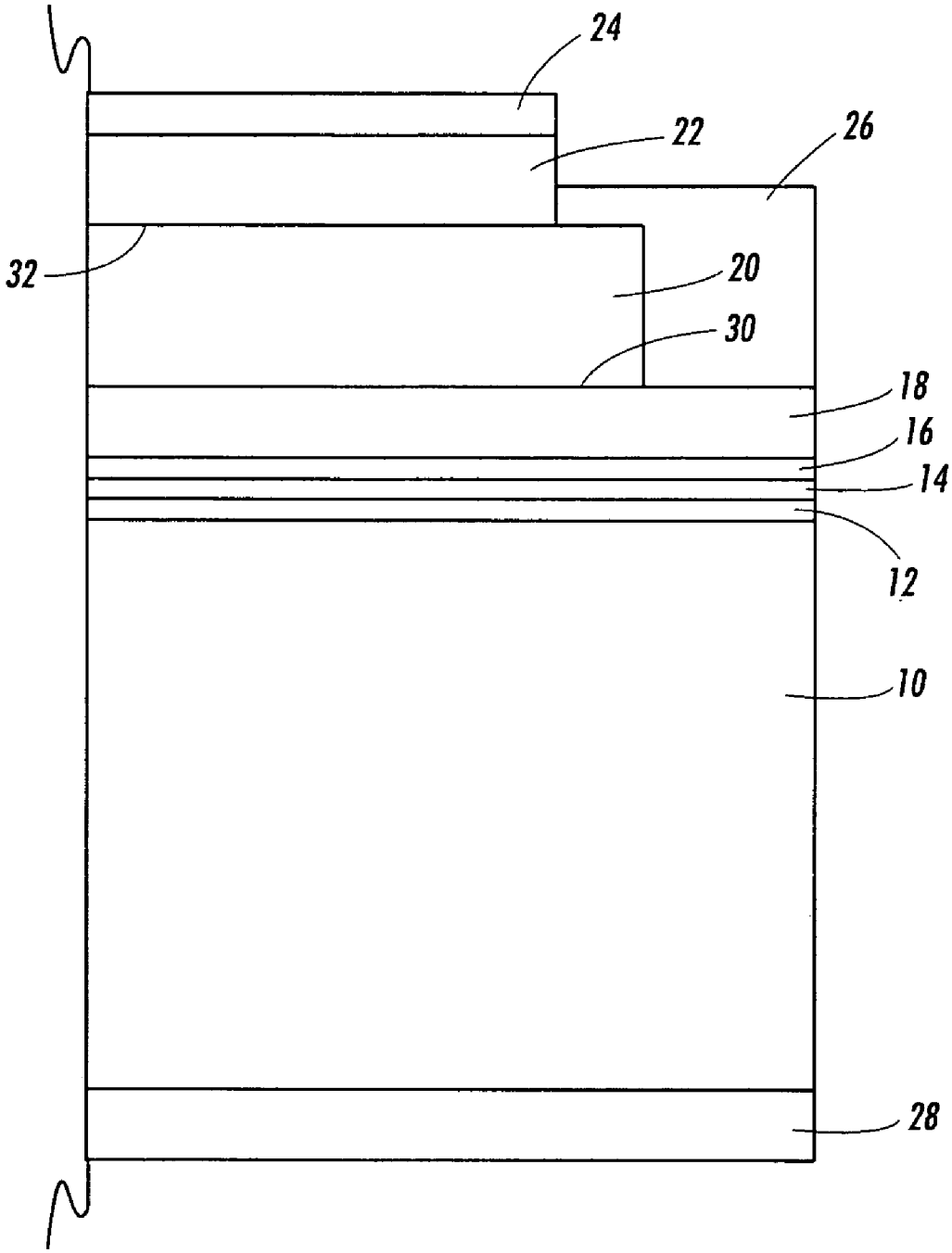
The Figure

IMAGING MEMBER

BACKGROUND

There is disclosed herein, in various embodiments, an imaging member used in electrophotography that reduces or eliminates charge deficient spots. The imaging member includes a charge transport layer that is spaced apart from a charge generation layer by an under-layer or a barrier layer. The composition of the under-layer and a configuration that spaces the charge transport layer apart from the charge generating layer reduces the concentration of charge transport molecules near the surface of the charge generating layer, which reduces charge deficient spots.

A typical electrophotographic imaging member is imaged by uniformly depositing an electrostatic charge on an imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas, This electrostatic latent image may then be developed to form a visible image by depositing finely divided electroscopic marking toner particles on the imaging member surface. The resulting visible toner image can then be transferred to a suitable receiving member, such as paper.

A number of current electrophotographic imaging members are multilayered photoreceptors that, in a negative charging system, comprise a substrate support, an electrically conductive layer, an optional charge blocking layer, an optional adhesive layer, a charge generating layer, a charge transport layer, and optional protective or overcoating layer(s). The multilayered photoreceptors can comprise several forms, for example, flexible belts, rigid drums, flexible scrolls, and the like. Flexible photoreceptor belts may either be seamed or seamless belts. An anti-curl layer may be employed on the back side of the flexible substrate support, the side opposite to the electrically active layers, to achieve a desired photoreceptor belt flatness.

Although excellent toner images may be obtained with multilayered belt photoreceptors, a delicate balance in charging image and bias potentials, and characteristics of toner/developer must be maintained. This places additional constraints on photoreceptor manufacturing, and thus, on the manufacturing yield. Localized microdefect sites, varying in size of from about 5 to about 200 microns, can sometimes occur in manufacture and appear as print defects (microdefects) in the final imaged copy. In charged area development, where the charged areas are printed as dark areas, the sites print out as white spots. These microdefects are called microwhite spots. In discharged area development systems, where the exposed area (discharged area) is printed as dark areas, these sites print out as dark spots on a white background. All of these microdefects, which exhibit inordinately large dark decay, are called "charge deficient spots" (CDS). Since the microdefect sites are fixed in the photoreceptor, the spots are registered from one cycle of belt revolution to next. Charge deficient spots have been a serious problem for a very long time in many organic photoreceptors, such as multilayered photoreceptors where a pigment is dispersed in a matrix of a bisphenol Z type polycarbonate film forming binder.

Whether these localized microdefect or charge deficient spot sites will show up as print defects in the final document depends, to some degree, on the development system utilized and, thus, on the machine design selected. For example, some of the variables governing the final print quality include the surface potential of photoreceptor, the image potential of the photoreceptor, photoreceptor to development roller spacing, toner characteristics (such as size, charge, and the like), the bias applied to the development rollers and the like. The image potential depends on the light level selected for exposure. The defect sites are discharged, however, by the dark discharge rather than by the light. The copy quality from generation to generation is maintained in a machine by continuously adjusting some of the parameters with cycling. Thus, defect levels may also change with cycling.

Techniques have been developed for the detection of CDS's. These have largely involved destructive testing, although some contactless methods have been developed. Additionally, multilayer imaging members have been developed to block charge injection from the substrate which can give rise to CDS's.

The present disclosure is directed to producing an improved imaging member that reduces or eliminates charge deficient spots, among other characteristics.

CROSS REFERENCE TO RELATED APPLICATIONS

The following applications, the disclosures of each being totally incorporated herein by reference, are mentioned:

U.S. application Ser. No. 11/158,119, filed Jun. 21, 2005, entitled "Imaging Member," by Satchidanand Mishra, et al. discloses an imaging member having a charge transport layer in which the concentration of a charge transport component is at a peak in a region of the charge transport intermediate the first and second surfaces of the charge transport layer.

U.S. application Ser. No. 10/744,369, filed Dec. 23, 2003, entitled "Imaging Members," by Satchidanand Mishra, et al. discloses a charge transport layer in which the concentration of a charge transport component decreases, such as by a decreasing concentration gradient, from the lower surface to an upper surface in the charge transport layer.

U.S. application Ser. No. 10/736,864, filed Dec. 16, 2003, entitled "Imaging Members," by Anthony M. Horgan, et al. discloses a charge transport layer of an imaging member that includes a plurality of charge transport layers coated from solutions of similar or different compositions or concentrations, wherein the upper or additional transport layer or layers comprise a lower concentration of charge transport component than the first (bottom) charge transport layer.

U.S. application Ser. No. 10/320,808, filed Dec. 16, 2002, now U.S. Pat. No. 6,933,089 which issued on Aug. 23, 2005, entitled "Imaging Members," by Anthony M. Horgan et al discloses a dual charge transport layer in which the top layer comprises a hindered phenol dopant.

U.S. application Ser. No. 11/158,119, filed Jun. 21, 2005, entitled "Imaging Member," by Satchidanand Mishra, et al. discloses an imaging member having a charge transport layer in which the concentration of a charge transport component is at a peak in a region of the charge transport intermediate the first and second surfaces of the charge transport layer.

U.S. application Ser. No. 11/156,882, filed Jun. 20, 2005, entitled "Imaging Member," by Satchidanand Mishra, et al. discloses an imaging member incorporating an undercoat layer intermediate an imaging layer and an electrically conductive layer. The undercoat layer includes a film forming polymer with a particulate material dispersed therein. The particulate material supports a charge blocking material thereon.

INCORPORATION BY REFERENCE

The following patents, the disclosures of which are incorporated in their entireties by reference, are mentioned:

Electrophotographic imaging members having at least two electrically operative layers including a charge generating layer and a transport layer comprising a diamine are disclosed in U.S. Pat. Nos. 4,265,990; 4,233,384; 4,306,008; 4,299,897; and, 4,439,507.

U.S. Pat. No. 5,830,614 relates to a photoreceptor that comprises a support layer, a charge generating layer, and two charge transport layers. A first of the charge transport layers consists of charge transporting polymer comprising a polymer segment in direct linkage to a charge transporting segment and a second transport layer comprises a charge transporting polymer as for the first layer, except that it has a lower weight percent of the charge transporting segment than that of the first charge transport layer.

U.S. Pat. Nos. 5,591,554; 5,576,130; and, 5,571,649 disclose methods for preventing charge injection from substrates which give rise to CDS's. These patents disclose an electrophotographic imaging member including a support substrate having a two layered electrically conductive ground plane layer comprising a layer comprising zirconium over a layer comprising titanium, a hole blocking layer, and an adhesive layer. The adhesive layer of the '554 patent includes a copolyester film forming resin, and the member further includes an intermediate layer comprising a carbazole polymer, a charge generation layer comprising a perylene or a phthalocyanine, and a hole transport layer, which is substantially non-absorbing in the spectral region at which the charge generation layer generates and injects photogenerated holes. The adhesive layer of the '130 patent comprises a thermoplastic polyurethane film forming resin. The adhesive layer of the '649 patent comprises a polymer blend comprising a carbazole polymer and a film forming thermoplastic resin in contiguous contact with a hole blocking layer.

U.S. Pat. No. 5,215,839 to Robert Yu discloses a layered electrophotographic imaging member. The member is modified to reduce the effect of interference caused by the reflections from coherent light incident on a ground plane. Modification involves an interface layer between a blocking layer and a charge generation layer, the interface layer comprising a polymer having incorporated therein filler particles of a synthetic silica or mineral particles. The filler particles scatter the light to prevent reflections from the ground plane back to the light incident the surface.

U.S. Pat. No. 6,326,111 to Chambers, et al. discloses a stable charge transport layer comprising a dispersion containing polytetrafluoroethylene particles and hydrophobic silica in a polycarbonate polymer binder and at least one charge transport material.

U.S. Pat. No. 6,294,300 to Carmichael, et al. discloses a photoconductor that includes a charge transport layer coated over a charge generator layer. A hole transport molecule is intentionally added to the charge generator layer preventing migration of hole transport molecules from the charge transport layer to the charge generator layer.

U.S. Pat. No. 5,378,566 to Yu, et al. discloses an electrophotographic imaging member including a substrate, a hole blocking adhesive layer, a charge generating layer and a charge transport layer. The hole blocking adhesive layer includes a polyester film forming binder having dispersed therein a particulate reaction product of metal oxide particles and a hydrolyzed reactant selected from nitrogen containing organosilanes, organotitanates and organozirconates.

U.S. Pat. No. 5,643,702 to Yu discloses an electrophotographic imaging member comprising a substrate layer, an adhesive layer comprising a thermoplastic polyurethane film forming resin, a thin vapor deposited charge generating layer consisting essentially of a thin homogeneous vacuum sublimation deposited film of an organic photogenerating pigment, and a charge transport layer.

U.S. Pat. No. 6,379,853 to Lin, et al. discloses an imaging member including charge transporting element including two sequentially deposited charge transport layers each including a hole transport material and an optional film forming binder. A first charge transport layer exhibits a first charge carrier transit time and second charge transport layer exhibits a second charge carrier transit time.

U.S. Pat. No. 4,639,402 to Mishra et al. discloses an electrostatographic imaging member that includes a photoconductive layer comprising an organic resin binder and photoconductive particles comprising selenium coated with thin layer of a reaction product of a hydrolyzed aminosilane. Suitable binders include poly-N-vinylcarbazole and poly(hydroxyether) resin.

U.S. Pat. Nos. 5,703,487; 6,008,653; 6,119,536; and, 6,150,824 disclose methods for detecting CDS's. In the '487 patent, a process for ascertaining the microdefect levels of an electrophotographic imaging member includes measuring either the differential increase in charge over and above the capacitive value or measuring reduction in voltage below the capacitive value of a known imaging member and of a virgin imaging member and comparing differential increase in charge over and above the capacitive value or the reduction in voltage below the capacitive value of the known imaging member and of the virgin imaging member.

U.S. Pat. No. 6,008,653 to Popovic, et al. discloses a method for detecting surface potential charge patterns in an electrophotographic imaging member with a floating probe scanner. The scanner includes a capacitive probe, which is optically coupled to a probe amplifier, and an outer Faraday shield electrode connected to a bias voltage amplifier. The probe is maintained adjacent to and spaced from the imaging surface to form a parallel plate capacitor with a gas between the probe and the imaging surface. A constant voltage charge is applied to the imaging surface prior to establishing relative movement of the probe and the imaging surface. Variations in surface potential are measured with the probe and compensated for variations in distance between the probe and the imaging surface. The compensated voltage values are compared to a baseline voltage value to detect charge patterns in the electrophotographic imaging member.

U.S. Pat. No. 6,150,824 to Mishra, et al. discloses a contactless system for detecting electrical patterns on the outer surface of an imaging member which includes repetitively measuring the charge pattern on the outer surface with an electrostatic voltmeter probe maintained at a substantially constant distance from the surface, the distance between the probe and the imaging member being slightly greater than the minimum distance at which Paschen breakdown will occur to form a parallel plate capacitor with a gas between the probe and the surface.

U.S. Pat. No. 5,703,487 to Mishra discloses a process for ascertaining the microdefect levels of an electrophotographic imaging member comprising the steps of measuring either the differential increase in charge over and above the capacitive value or measuring reduction in voltage below the capacitive value of a known imaging member and of a virgin imaging member and comparing differential increase in charge over and above the capacitive value or the reduction in voltage below the capacitive value of the known imaging member and of the virgin imaging member.

BRIEF DESCRIPTION

The present disclosure relates, in various exemplary embodiments, to an imaging member and a method of formation. In one aspect, the imaging member includes a charge transport layer that is spaced from a charge generation layer by an under-layer or barrier layer. Such an imaging member produces reduced charge deficiency spots.

In another aspect, an imaging member includes an optional substrate; a charge generating layer; a charge transport layer disposed about the charge generating layer; and a barrier layer disposed intermediate the charge generating layer and the charge transport layer. The barrier layer comprises a film forming polymeric binder material selected from a conductive binder, a non-conductive binder, and mixtures thereof, and optionally a limited concentration of a charge transport material.

In still another aspect, an imaging member includes an optional substrate; a photogenerating layer; a barrier layer disposed over the photogenerating layer; and a charge transport layer disposed over the barrier layer. The barrier layer comprises (i) a polymeric binder material selected from a conductive polymer binder, a non-conductive polymer binder, and mixtures thereof, and (ii) a charge transport material. The charge transport material is of a composition and an amount sufficient to produce a mobility of at least 10%, including about 40% of the hole mobility of the charge transport layer.

In yet another aspect, an imaging member includes an optional substrate; a charge generating layer; a first layer comprising a first film forming polymer binder selected from a non-conductive polymer binder, a conductive polymer binder, and mixtures thereof; a charge transport layer; and a second layer comprising a second film forming polymer binder selected from a non-conductive polymer binder, a conductive polymer binder, and mixtures thereof; wherein the first layer is disposed intermediate the charge generating layer and the charge transport layer, and the second layer is disposed over the charge transport layer.

In still another aspect, an imaging member includes an optional substrate; a photogenerating layer, a barrier layer disposed over the photogenerating layer; and, a charge transport layer disposed over the barrier layer comprising one or more layers. In this aspect, the barrier layer comprises a conductive binder, a non-conductive binder or mixtures thereof, and a small amount of a charge transport material, such as from about 0 to about 10% by weight of the barrier layer, including from about 3% to about 10% by weight of the barrier layer, and about 5% by weight of the barrier layer. In a still further aspect, the thickness of the barrier layer is from about 1 to about 10 micrometers, including from about 2.5 to about 7.5 micrometers.

These and other non-limiting features or aspects of the exemplary embodiments of the present disclosure will be described with regard to the drawings and the detailed description set forth below.

BRIEF DESCRIPTION OF THE DRAWINGS

The following is a brief description of the drawings which is provided for the purposes of illustrating one or more of the exemplary embodiments described herein and not for the purposes of limiting the same.

FIG. 1 is a schematic cross sectional view of an exemplary imaging member according to a first embodiment.

DETAILED DESCRIPTION

The disclosure is directed, in various exemplary embodiments, to an imaging member, to a method of formation of an imaging member, and to a method of use of such an imaging member. Although the embodiments disclosed herein are applicable to electrophotographic imaging members in flexible belt configuration and rigid drum form, for reason of simplicity, the discussions below are focused upon electrophotographic imaging members in flexible belt designs.

In aspects of the exemplary embodiment disclosed herein, there is provided an imaging member that includes a photogenerating (charge generating) layer, a charge transport layer disposed about the charge generating layer, and an under-layer, also referred to herein as a barrier layer, disposed between the charge generating layer and the charge transport layer. The under-layer has a lower surface which is in contiguous contact with the charge generating layer, and an upper surface which is in contiguous contact with the charge transport layer. The under-layer comprises a film forming polymer binder, a film forming polymer that functions as a charge transport carrier, or a mixture thereof. The charge transport layer is spaced apart from the charge generating layer by the under-layer and comprises one or more charge transport components, such as hole transport molecules or film forming charge transport polymers, which allow free charge photogenerated in the charge transport layer to be transported across the charge transport layer. The hole transport molecules or film forming charge transport polymers may be molecularly dispersed or dissolved in a film forming binder to form a solid solution. The under-layer may be selected to inhibit the formation of charge deficient spots (CDS) in images which may otherwise occur as a result of one or more charge transport components present in the charge transport layer.

In one aspect, the charge transport component of the charge transport layer comprises an aryl amine, such as (N,N'-diphenyl-N,N'-bis[3-methylphenyl]-[1,1'-biphenyl]-4,4'-diamine) (m-TBD). The charge transport component of the charge transport layer may be molecularly dispersed in a film forming binder that has little or no inherent charge transporting capability, such as polycarbonate.

In a further aspect, the under-layer comprises polyvinylcarbazole (PVK), which is an inherent hole transporting polymer. An under-layer comprising polyvinylcarbazole reduces the tendency for formation of CDS in images by m-TBD in the charge transport layer. In another aspect, an under-layer comprises a polycarbonate, such as poly(4,4'-isopropylidene diphenyl)carbonate. In one aspect, the hole mobility of the under-layer comprising, for example, polyvinylcarbazole and/or a polycarbonate, is less than that of the charge transport layer. The hole mobility in the under-layer may be at least 10% and in one embodiment, about 40% of the hole mobility of the charge transport layer. For example, the hole mobility of the under-layer may be equivalent to that of a layer comprising 20% m-TBD dispersed in a polycarbonate binder.

To provide a further enhancement of CDS suppression, an under-layer such as, for example, a polyvinylcarbazole-containing layer, may further comprise a dopant such as one or more of butylated hydroxytoluene (BHT) tetramethyl guanidine (TMG), triethanolamine (TEA), n-dodecylamine (DA), n-hexadecylamine (HA), 3-aminopropyltriethoxy silane, 3-aminopropyltrihydroxysilane and its oligomers and mixtures and salts thereof. The dopant is selected to further reduce CDS and may be present at from about 20 to about 5000 ppm of the layer.

In one specific aspect, the under-layer includes tritolylamine (TTA), 1,1-bis(4-(p-tolyl)aminophenyl)cyclohexane (TAPC); and N,N'-bis(4-methylphenyl)-N,N'-bis(4-ethylphenyl)-[1,1'-(3,3'-dimethyl)biphenyl]-4,4'-diamine (Ab-16) or various combinations thereof. In another aspect, the binder includes polystyrene or other material which is less polar than the binder used in the charge transport layer. By spacing an m-TBD-containing layer from the charge generation layer with the under-layer containing one or more of these molecules, charge deficient spots are reduced.

In another aspect, the underlayer includes TAPC. TAPC has higher activation energy and, hence, lower mobility than some other charge transport molecules. Furthermore, the use of polystyrene as binder (less polar materials) improves the charge injection from the charge generation layer to the charge transport layer, improves charge transporting and provides a robust coating layer. This device showed significant CDS reduction.

In other aspects, the concentration of the charge transport component in the charge transport layer may increase stepwise, or gradually, as for example, by an increasing concentration gradient, away from the lower surface of the charge transport layer toward the upper surface. Alternatively, the concentration of the charge transport component in the charge transport layer may progressively increase from the region closest in proximity to the under-layer and then may decrease toward the upper region of the charge transport layer. It is to be appreciated that the charge transport layer may include one or more layers or that the composition of the charge transport layer may change gradually or stepwise.

In aspects disclosed herein, the solid solution charge transport layer may have multiple regions of different concentrations of charge transport component. The charge transport layer may comprise a solid solution of different concentrations of charge transport components, film forming polymer binders/resins and other compounds to form two or more regions.

In one aspect, the charge transport layer comprises different regions or layers of a solid solution of a film forming polymer binder containing different concentrations of charge transport component(s) wherein the layer of the largest concentration of charge transport components is spaced from the bottom surface of the charge transport layer and lower concentrations of charge transport components are at the top and bottom surfaces of the charge transport layer.

In a further embodiment, the charge transport layer can comprise multiple charge transport layers comprising a first or bottom charge transport layer comprising a solid solution of a film forming polymer binder and a charge transport component, and thereover and in contact with the first layer, a second solid solution charge transport layer or layers, the first layer being spaced from the photogenerating layer by the under-layer, the second layer having a higher concentration of charge transport component than the first layer and optionally one or more additional solid solution charge transport layers. The second layer and subsequent additional charge transport layers each can consist of the same or a different film forming polymer binder and same or different charge transport component as that of the first charge transport layer.

It has been found that the charge injection from a source such as the photogenerating layer, into the charge transport layer is influenced by the number (concentration) of charge transport molecules in the vicinity. By providing an under-layer as described herein, the migration rate of charge from the charge generating layer into the charge transport layer can be suppressed and CDS spots in images generated by the imaging member can be significantly reduced. Both types of CDS spots can be reduced-discharge development spots, which appear as microblack spots on white backgrounds, and charger development spots, which appear as microwhite spots on dark backgrounds, can be suppressed by lowering the concentration of the charge transport component in the under-layer adjacent to the charge generation layer. The mobility of the injected charge is also suppressed as a result of the lower concentration of charge transport component. Accordingly, the provision of a second layer that provides a higher charge mobility, for example, by incorporating a higher concentration of charge transport component, spaced from the charge generation layer, facilitates movement of the charge through the charge transport layer overall. Charge mobility can be expressed in terms of average velocity of the charge passing through a unit area per unit field of the imaging member.

The optional, additional charge transport layers in the charge transport layer may also contain a stabilizing antioxidant such as a hindered phenol. Such a phenol may be present in the top most layer of the charge transport layer in a reverse concentration gradient to that of the charge transport component. For example, while the concentration of the charge transport component increases from the first or bottom layer (or the layer in closest proximity to the photogenerating layer) and decreases again toward the top layer in the overall charge transport layer, the concentration of the hindered phenol increases near the top surface of the charge transport layer and decreases away from it. Furthermore, in order to achieve enhanced wear resistance results, the top or uppermost layer or region of the charge transport layer may further include particles dispersions of silica, PTFE, and wax polyethylene for effective lubrication and wear life extension or be provided with an overcoat.

Advantages associated with the imaging members of the present exemplary embodiments include, for example, a reduction in charge deficient spots (CDS) in images generated with the imaging member. Additional advantages may include the avoidance or suppression of early onset of charge transport layer cracking. Such cracking or micro-cracking can be initiated by the interaction with effluent of chemical compounds, such as exposure to volatile organic compounds, like solvents, selected for the preparation of the members and corona emissions from machine charging devices. Such cracking can lead to copy print out defects and also may adversely affect functional characteristics of the imaging member.

Processes of imaging, especially xerographic imaging and printing, including digital printing, are also encompassed by the present disclosure. More specifically, the layered photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members disclosed are useful in color xerographic applications, particularly high-speed color copying and printing processes and which members are in embodiments sensitive in the wavelength region of, for example, from about 500 to about 900 nanometers, and in particular from about 650 to about 850 nanometers, thus diode lasers can be selected as the light source.

An exemplary embodiment of the multilayered electrophotographic imaging member of flexible belt configuration is illustrated in FIG. 1. The exemplary imaging member includes an optional support substrate 10 having an optional conductive surface layer or layers 12, an optional hole blocking layer 14, an optional adhesive layer 16, a charge generating layer 18, an under-layer 20, at least one charge transport layer 22, and optionally one or more overcoat and/or protective layer(s) 24. Other layers of the imaging member may include, for example, an optional ground strip layer 26, applied to one edge of the imaging member to promote electrical continuity with the conductive layer 12 through the hole blocking layer 14. An anti-curl back coating layer 28 may be formed on the backside of the flexible support substrate. The layers 12, 14, 16, 18, 20, 22, and 24 may be separately and sequentially deposited on the substrate 10 as solutions comprising a solvent, with each layer being dried before deposition of the next. Alternatively or additionally, the charge transport layer or the layer of the charge transport layer nearest the under-layer 20 may be applied prior to drying of the previous layer such that partial mixing at the boundaries of adjacent layers and/or leaching diffusion of one or more components from one layer into the adjacent layer(s) can occur.

In the illustrated embodiment, under-layer 20 has a lower surface 30 that is in direct contact with the upper surface of the charge generating layer 18 and an upper surface 32 that is in direct contact with the lower surface of the charge transport layer 22.

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The substrate 10 can also be formulated entirely of an electrically conductive material, or it can be an insulating material including inorganic or organic polymeric materials, such as, MYLAR™, a commercially available biaxially oriented polyethylene terephthalate from DuPont, MYLAR™ with a coated conductive titanium surface, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may be flexible, being seamed or seamless for flexible photoreceptor belt fabrication or it can be rigid for use as an imaging member for plate design applications. The substrate may have a number of many different configurations, such as, for example, a plate, a drum, a scroll, an endless flexible belt, and the like. In one embodiment, the substrate is in the form of a seamed flexible belt.

The thickness of the substrate 10 depends on numerous factors, including flexibility, mechanical performance, and economic considerations. The thickness of the support substrate 10 may range from about 50 micrometers to about 3,000 micrometers; and in embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers. The surface of the support substrate is cleaned prior to coating to promote greater adhesion of the deposited coating composition.

An exemplary substrate support 10 is not soluble in any of the solvents used in each coating layer solution, is optically transparent, and is thermally stable up to a high temperature of about 150° C. A typical substrate support 10 used for imaging member fabrication has a thermal contraction coefficient ranging from about $1\times10^{-5}$/° C. to about $3\times10^{-5}$/° C. and a Young's Modulus of between about $5\times10^{5}$ psi ($3.5\times10^{4}$ Kg/cm$^2$) and about $7\times10^{s}$ psi ($4.9\times10^{4}$ Kg/cm$^2$).

The conductive layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 20 Angstroms to about 750 Angstroms to enable adequate light transmission for proper back erase, and in embodiments from about 100 Angstroms to about 200 Angstroms for an optimum combination of electrical conductivity, flexibility, and light transmission. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted.

A positive charge (hole) blocking layer 14 may then optionally be applied to the substrate 10 or to the layer 12, where present. Generally, electron blocking layers for positively charged photoreceptors allow the photogenerated holes in the charge generating layer 18 at the surface of the photoreceptor to migrate toward the charge (hole) transport layer below and reach the bottom conductive layer during the electrophotographic imaging processes. Thus, an electron blocking layer is normally not expected to block holes in positively charged photoreceptors, such as, photoreceptors coated with a charge generating layer over a charge (hole) transport layer. Any suitable hole blocking layer capable of forming an effective barrier to holes injection from the adjacent conductive layer 12 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxypropyl cellulose, polyphosphazine, and the like, or may comprise nitrogen containing siloxanes or silanes, nitrogen containing titanium or zirconium compounds, such as, titanate and zirconate. Hole blocking layers having a thickness in wide range of from about 50 Angstroms (0.005 micrometers) to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri( N-ethylaminoethylamino)titanate, isopropyl trianthranil titanate, isopropyl tri(N,N-dimethylethy[amino)titanate, titanium-4-amino benzene sulfonate oxyacetate, titanium 4-aminobenzoate isostearate oxyacetate, $[H_2N(CH_2)_4]CH_3Si(OCH_3)_2$, (gammaminobutyl)-methyl diethoxysilane, and $[H_2N(CH_2)_3]CH_33Si(OCH_3)_2$, (gammaminopropyl)-methyl diethoxysilane, and combinations thereof, as disclosed in U.S. Pat. Nos. 4,338,387, 4,286,033 and 4,291,110, incorporated herein by reference in their entireties. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The blocking layer 14 is continuous and may have a thickness of less than about 10 micrometers because greater thicknesses may lead to undesirably high residual voltage. In aspects of the exemplary embodiment, a blocking layer of from about 0.005 micrometers to about 2 micrometers facilitates charge neutralization after the exposure step and optimum electrical performance is achieved. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The optional adhesive layer 16 may be applied to the hole blocking layer 14. Any suitable adhesive layer may be utilized. One well known adhesive layer includes a linear saturated copolyester reaction product of four diacids and ethylene glycol. This linear saturated copolyester consists of alternating monomer units of ethylene glycol and four randomly sequenced diacids in the above indicated ratio and has a weight average molecular weight of about 70,000. If desired, the adhesive layer may include a copolyester resin. The adhesive layer is applied directly to the hole blocking layer. Thus, the adhesive layer in embodiments is in direct contiguous contact with both the underlying hole blocking layer and the overlying charge generating layer to enhance adhesion bonding to provide linkage. In embodiments, the adhesive layer is continuous.

Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive layer 16 may have a thickness of from about 0.01 micrometers to about 900 micrometers after drying. In embodiments, the dried thickness is from about 200 micrometers and about 900 micrometers, although thicknesses of from about 0.03 micrometers to about 1 micrometer are satisfactory for some applications. At thicknesses of less than about 0.01 micrometers, the adhesion between the charge generating layer and the blocking layer is poor and delamination can occur when the photoreceptor belt is transported over small diameter supports such as rollers and curved skid plates.

The photogenerating (charge generating) layer 18 may thereafter be applied to the blocking layer 14 or adhesive layer 16, if one is employed. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength from about 400 nm to about 850 nm and about 700 nm to about 850 nm during the imagewise radiation exposure step in an electrophotographic imaging process to form an electrostatic latent image.

Any suitable inactive resin materials may be employed in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 30 percent by volume to about 50 percent by volume of the photogenerating material is dispersed in about 50 percent by volume to about 70 percent by volume of the resinous binder composition.

The photogenerating layer 18 containing the photogenerating material and the resinous binder material generally ranges in thickness of from about 0.1 micrometer to about 5 micrometer for example, from about 0.3 micrometers to about 3 micrometers when dry. The photogenerating layer thickness is generally related to binder content. Higher binder content compositions generally employ thicker layers for photogeneration.

The next layers applied over the charge generating layer 18 include under-layer 20 and charge transport layer 22. The under-layer 20, which is also referred to herein as a barrier layer, is applied over the charge generating layer 18, and charge transport layer 22 is then applied over the barrier or under-layer. Thus, barrier or under-layer 20 spaces the charge transport layer 22 away from charge generating layer 18. In conventional imaging members, the charge transport layer is applied directly over the charge generating layer, and there is typically a relatively large concentration of charge transport molecules along the interface between the charge generating layer and the charge transport layer. The presence of charge transport molecules at this interface causes or results in charge deficient spots. By spacing the charge transport layer away from the charge generating layer with a barrier layer intermediate the charge transport layer and the charge generating layer, the concentration of charge transport molecules near the surface of the charge generating layer can be reduced or eliminated, which will reduce or eliminate charge deficient spots.

Barrier or under-layer 20 consists essentially of a film forming polymeric binder material. The polymeric binder material may be a conductive polymer binder, a non-conductive polymer binder, or mixtures of conductive and non-conductive polymer binder materials. As will be discussed below, the barrier layer may also include a relatively small concentration of charged transport molecules.

Suitable conductive polymer binders include materials capable of conducting charge, including those materials that function as hole or charge transport carriers. One example of a conductive polymer binder suitable for the barrier layer is a carbazole polymer. In one embodiment a polycarbazole may be a material of the formula

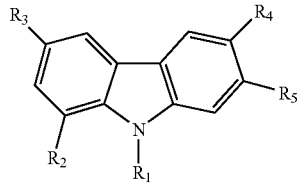

wherein $R_1$ is selected from

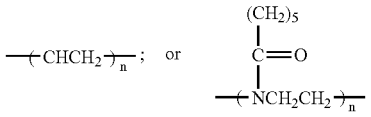

and $R_{2-5}$ are independently selected from H, alkyl, substituted alkyl, alkoxy, and the like and combinations thereof. In one embodiment, the conductive polymer binder includes polyvinyl carbazole, which has the formula

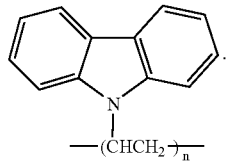

Other examples of a carbazole polymer suitable for use in the barrier layer include, but are not limited to, polycarbazoles of the formulas

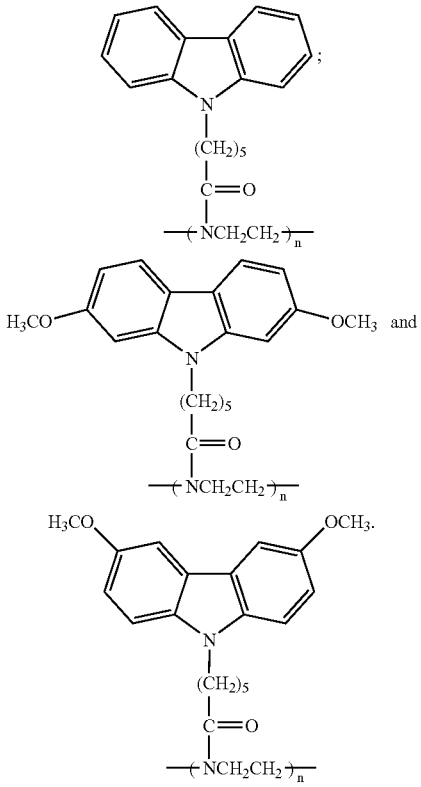

Other conductive polymers suitable for use in the barrier layer include benzidine base polymers. Examples of suitable benzidine polymers include, but are not limited to, poly[oxydecamethyleneoxy-N,N'-diphenyl-N,N'-bis(3-carbonylphenyl)benzidine], poly[oxydecamethyleneoxy-N,N'-diphenyl-N,N'-bis(4-carbonylphenyl)benzidine], and the like.

The barrier layer may also include or be formed from a non-conductive or inactive polymer binder. Suitable non-conductive polymer binders include those that are typically used in other layers of an imaging member such as the photogenerating layer or the charge transport layer. Suitable non-conductive binders include, but are not limited to, polycarbonate resin, polyester, polyarylate, polyacrylate, polyether, polysulfone, polyvinyl butyrals, polyvinyl formals, and combinations thereof. Exemplary polycarbonates include poly(4-4'-isopropylidene diphenyl carbonate), poly(4,4'-diphenyl-1-1'-cyclohexene carbonate), and the like. An exemplary polycarbonate is a Makrolon™ binder, which is available from Bayer AG and comprises poly(4-4'-isopropylidene diphenyl) carbonate having a weight average molecular weight of about 120,000.

The barrier or under-layer consists predominantly of polymeric binder. The barrier or under-layer may include from about 90 to about 100% by weight of polymeric binder material. The polymeric binder may include a conductive polymer binder, non-conductive polymer binder, and mixtures of conductive and non-conductive binders. In one embodiment, for example, the barrier layer consists essentially of about 100% by weight of a conductive polymer binder. In another embodiment, the barrier layer consists essentially of about 100% by weight of a non-conductive polymer binder. It will be appreciated that an under-layer consisting essentially of either a conductive binder or a non-conductive binder may include mixtures of conductive binders or mixtures of non-conductive binders. In still another embodiment, the barrier layer consists essentially of a mixture of conductive and non-conductive polymer binders in an amount of about 100% by weight. In a composition that is a mixture of a conductive and non-conductive polymer binder, the conductive polymer binder may be present in an amount of from about 1 to about 99% by weight, and the non-conductive binder may be present in an amount of 1 to about 99% by weight. In another embodiment, a mixture of conductive and non-conductive polymer binders may comprise from about 30 to about 70% by weight of a conductive polymer binder, and from about 30 to about 70% by weight of a non-conductive polymer. In still another embodiment, a mixture of conductive and non-conductive polymer binder may comprise from about 40 to about 60% by weight of a conductive polymer binder, and from about 40 to about 60% by weight of a non-conductive polymer binder.

As previously described, the barrier or under-layer may also include a small amount of charge transport molecule. The barrier layer may have from about 0 to about 40% by weight of a charge transport material. In one embodiment, the barrier or under-layer includes a charge transport material in an amount from about greater than 0% by weight to about 10% by weight. In another embodiment, the barrier layer includes from about 3 to about 10% by weight of a charge transport material. And in still another embodiment, the barrier layer may include about 5% by weight of a charge transport material. The charge transport material present in the barrier layer is not limited in any manner, and may be selected from any material or molecule known in the art or later discovered to be capable of acting as a charge transport molecule as is understood in the art. Examples of suitable charge transport materials that may be included in the barrier or under-layer include those described in co-pending application Ser. Nos. 10/736,864, 10/744,369, and 10/320,808, all of which are incorporated herein by reference in their entirety. Other exemplary charge transporting materials include aromatic diamines, such as aryl diamines. Exemplary aromatic diamines include, but are not limited to, N,N'-diphenyl-N,N'-bis(alkylphenyl)-1,1'-biphenyl-4,4-diamines, such as m-TBD, which has the formula (N,N'-diphenyl-N,N'-bis[3-methylphenyl]-[1,1-biphenyl]-4,4'-diamine); N,N'-diphenyl-N,N'-bis(chlorophenyl)-1,1'-biphenyl-4,4'-diamine; and N,N'-bis-(4-methylphenyl), N,N'-bis(4-ethylphenyl)-1,1'-3,3 dimethylbiphenyl)-4,4-diamine (Ae-16), and combinations thereof. Other exemplary aromatic diamines include N,N'-bis-(4-methoxy-2-methyl-phenyl)-N,N'-diphenyl-biphenyl-4,4'-diamine. Another suitable charge transport material includes 1,1-bis(4-(p-tolyl)aminophenyl)cyclohexene (TAPC). Other exemplary charge transport materials include arylamines, such as, for example, tri(4-methylphenyl)amine, N,N,-di(3,4dimethyl)phenyl, N-(4-biphenyl)amine, and the like.

Charge transport molecules or materials in the barrier or under-layer may be present by design or by the nature of forming the charge transport layer over the barrier layer. Thus in one embodiment, the charge transport material may be included in a composition with a conductive and/or non-conductive binder that is used to form the barrier or under-layer. In another embodiment, the charge transport material may be present in the barrier or under-layer as a result of diffusion of charge transport material into the barrier layer from the composition used to form the charge transport layer as the charge transport layer is applied over the barrier layer. Regardless of how charge transport material is present, if it all, in the barrier layer, the concentration of charge transport material that is present along the interface between the charge generating layer and the barrier layer is reduced or eliminated as compared to conventional imaging members where the charge transport layer is applied directly over the charge generating layer.

The barrier or under-layer may have any thickness as desired for a particular purpose or intended use. As the thickness of the barrier layer increases, charge deficiency spots may be reduced relative to thinner layers. In thicker barrier layers, while charge transport material from the charge transport layer above the barrier layer will likely diffuse into the barrier layer, the depth of penetration is not as great as compared to barrier layers of smaller thickness. Consequently, there is a smaller concentration of charge transport material near the upper surface of the charge generating layer. In one embodiment, the barrier layer has a thickness of from about 1 to about 15 micrometers. In still another embodiment, the barrier layer has a thickness of from about 1 to about 10 micrometers. In another embodiment, the barrier layer has a thickness of from about 2.5 to about 5 micrometers.

The charge transport layer 22 is thereafter applied over the under-layer 20 and may include any suitable transparent organic polymer or non-polymeric material capable of supporting the injection of photogenerated holes or electrons from the charge generating layer 18 via the under-layer 20 and capable of allowing the transport of these holes through the charge transport layer to selectively discharge the surface charge on the imaging member surface. In one embodiment, the charge transport layer 22 not only serves to transport holes, but also protects the charge generating layer 18 from abrasion or chemical attack and may therefore extend the service life of the imaging member. The charge transport layer may be a single layer or multi-layer configuration. Multi-layer configurations comprise two or more charge transport layers. The charge transport layer 22 can be a substantially non-photoconductive material, but one which supports the injection of photogenerated holes from the charge generation layer 18. In one embodiment the charge transport layer is free or substantially free of photogenerating materials (e.g., the charge transport layer contains less than 1% of the concentration of photogenerating materials in the charge generating layer 18 and in one embodiment, less than 0.01% thereof. Any individual layers or sub-layers of the overall charge transport layer 22 are normally transparent in a wavelength region in which the electrophotographic imaging member is to be used when exposure is effected therethrough to ensure that most of the incident radiation is utilized by the charge generating layer 18. Each charge transport layer in a multi-layered charge transport layer configuration should exhibit excellent optical transparency with negligible light absorption and neither charge generation nor discharge if any, when exposed to a wavelength of light useful in xerography, e.g., 4000 to 9000 Angstroms. In the case when the photoreceptor is prepared with the use of a transparent substrate 10 and also a transparent conductive layer 12, imagewise exposure or erase may be accomplished through the substrate 10 with all light passing through the back side of the substrate. In this case, the materials of the charge transport layer's individual layers or sub-layers need not transmit light in the wavelength region of use if the charge generating layer 18 is sandwiched between the substrate and the charge transport layer 22. The charge transport layer 22 in conjunction with the charge generating layer 18 is an insulator to the extent that an electrostatic charge placed on the charge transport layer is not conducted in the absence of illumination. The charge transport layer 22 and any intermediate and top charge transport layers should trap minimal charges as the case may be passing through it. Charge transport layer materials are well known in the art.

The charge transport layer 22 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photogenerated holes from the generation material and incapable of allowing the transport of these holes therethrough. This converts the electrically inactive polymeric material to a material capable of supporting the injection of photogenerated holes from the charge generation layer 18 via under-layer 20 and capable of allowing the transport of these holes through the charge transport layer 22 in order to discharge the surface charge on the charge transport layer. The charge transport component typically comprises small molecules of an organic compound that cooperate to transport charge between molecules and ultimately to the surface of the charge transport layer.

Although the film forming polymer binder used may be different for different charge transport layers, in one embodiment, an identical polymer binder is used throughout the charge transport layer 22 which tends to provide improved interfacial adhesion bonding between any individual charge transport layers.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexene carbonate), and combinations thereof. The molecular weight of the binder can be for example, from about 20,000 to about 1,500,000. One exemplary binder of this type is a Makrolon™ binder, which is available from Bayer AG and comprises poly(4,4'-isopropylidene diphenyl) carbonate having a weight average molecular weight of about 120,000.

Exemplary charge transport components include those described in above-mentioned co-pending application Ser. Nos. 10/736,864, 10/744,369, and 10/320,808, incorporated herein by reference, which may be used singly or in combination for individual charge transport layers in a charge transport having a multi-layer configuration. Exemplary charge transporting components include aromatic diamines, such as aryl diamines. Exemplary diphenyl diamines suited for use as the charge component, singly or in combination, are represented by the molecular Formula I below:

FORMULA 1

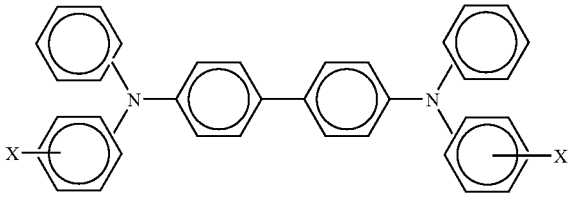

wherein each X is independently selected from the group consisting of alkyl, hydroxy, and halogen. Typically, the halogen is a chloride. Where X is alkyl, X can comprise from 1 to about 10 carbon atoms, e.g., from 1 to 5 carbon atoms, such as methyl, ethyl, propyl, butyl, and the like. Exemplary aromatic diamines of this type include N,N'-diphenyl-N,N'-bis(alkylphenyl)-1,1'-biphenyl-4,4-diamines, such as m-TBD, which has the formula (N,N'-diphenyl-N,N'-bis[3-methylphenyl]-[1,1-biphenyl]-4,4'-diamine); N,N'-diphenyl-N,N'-bis(chlorophenyl)-1,1'-biphenyl-4,4'-diamine; and N,N'-bis-(4-methylphenyl), N,N'-bis(4-ethylphenyl)-1,1'-3,3 dimethylbiphenyl)-4,4-diamine (Ae-16), and combinations thereof.

Other layers such as conventional ground strip layer 26 including, for example, conductive particles dispersed in a film forming binder may be applied to one edge of the imaging member to promote electrical continuity with the conductive layer 12 through the hole blocking layer 14, and adhesive layer 16. Ground strip layer 26 may include any suitable film forming polymer binder and electrically conductive particles. Typical ground strip materials include those enumerated in U.S. Pat. No. 4,664,995, the entire disclosure of which is incorporated by reference herein. The ground strip layer 26 may have a thickness from about 7 micrometers to about 42 micrometers, for example, from about 14 micrometers to about 23 micrometers. Optionally, an overcoat layer 24, if desired, may also be utilized to provide imaging member surface protection as well as improve resistance to abrasion and scratching.

In one embodiment, the charge transport layer 22 comprises multiple concentration regions of a binary solid solution comprising a film forming polymer binder and a charge transport component comprising one or more aromatic amine hole transporting compounds according to Formula I or any other suitable aromatic amine of the type disclosed herein. The charge transport layer may comprise a first layer closest to the under-layer 20, having a lower concentration of charge transport component than a second, which is above the first layer, and may comprise, for example, at least about 5 weight percent and may comprise up to about 40 weight percent of charge transport component, e.g., from about 10 to about 35 wt %. All charge transport component concentrations are expressed by weight of the dried layer, unless otherwise indicated. The second layer, spaced from the under-layer by the first layer, has a higher concentration of charge transport component than the first layer, such that the mobility of charge in the second layer is higher than in the first layer. The second layer may comprise, for example, at least about 30 weight percent and may comprise up to about 90 weight percent of charge transport component, e.g., from about 35 to about 50 wt %. The concentration of the charge transport component in the first layer can be from about 1% to about 95% of the concentration of the charge transport component in the second layer, expressed by weight. In one embodiment, the charge transport component concentration in the first layer is at least about 5% of that of the second layer, in another embodiment, at least about 20%, and in yet another embodiment, at least 30%, In one embodiment, the charge transport component concentration in the first layer is less than about 90% of that of the second layer, in another embodiment, less than about 80%, and in yet another embodiment, about 60% or less of that of the second layer. At low concentration ratios, the effects of the low concentration of the charge transport component in the first layer on the charge mobility can be offset by making the first layer of a lower thickness than second layer.

The ratio of charge mobility in the second layer to that in the first layer can be, for example, from about 3:1 to about 100:1. Other ratios include from about 5:1 to about 50:1.

The first layer may be from about 2 to about 15 microns in thickness and the second layer total thickness can be from about 10 microns to about 35 microns in thickness. For example, the thickness of the first layer can be less than that of the second layer. In one embodiment, the ratio of the thickness of the second layer to that of the first layer can be, for example, at least about 1.2:1 and in one embodiment, at least 1,5:1 and in another embodiment, at least about 1.8:1. The ratio can be up to about 10:1, or higher. As noted above, the higher ratios are particularly suited to cases where the concentration ratio is high.

In other embodiments, a charge transport layer may optionally include additional layers, such as a third layer. A third layer will be spaced from the charge generating layer 18 by the under-layer 20, a first charge transport layer, and a second charge transport layer. The second charge transport layer is thus sandwiched between the first layer and the third layer, with the third layer providing the upper surface of the charge transport layer 22. The third layer may be in contiguous contact with the second layer, or where several intermediate layers are employed, with the uppermost intermediate layer.

In a multi-layered charge transport layer, the individual layers may be similarly formed in that they contain a charge transport component, such as that used for other layers, or a different charge transport component, which may be any suitable charge transport component useful as an additive molecularly dispersed in an electrically inactive polymeric material to form a solid solution and thereby making this material electrically active. In embodiments comprising three layers, the third layer has a lower concentration of the charge transport component than the second layer. The charge mobility in the third layer may thus be lower than in the second layer. The concentration can be the same or somewhat higher or lower than that of the charge transport component in the second layer. For example, the concentration of the charge transport component in the third layer can be from about 1% to about 95% of the concentration of the charge transport component in the second layer (or from about 1% to about 95% of the highest concentration in the second layer, where the concentration varies in the second layer). In one embodiment the charge transport component concentration in the third layer is at least about 5% of that of the second layer, in another embodiment, at least about 20%, and in yet another embodiment, at least 30%. In one embodiment the charge transport component concentration in the third layer is less than about 90% of that of the second layer, in another embodiment, less than about 80%, and in yet another embodiment, about 60% or less of that of the second layer. The charge transport component concentration in the third layer can be approximately the same or somewhat higher or lower than that of the first layer, for example, from about 50% to about 300% of the concentration in the first layer. The concentration of the charge transport component in the charge transport layer 22, in this embodiment, thus increases with distance from the under-layer 20 and then decreases again towards the upper surface of the charge generation layer. The third layer, may comprise, for example, at least about 5 weight percent and may comprise up to about 50 weight percent of charge transport component, e.g., from about 5 to about 45 wt %.

The thickness of the third layer can be less than the thickness of the second layer and can be from about 1 micron to about 10 microns. Other thicknesses include from about 2 microns to about 5 microns.

The charge transport layer 22 may be formed by depositing a single layer or sequential deposition of multiple sub-layers on the under-layer 20. For example, in one there may be from 2 to about 15 sublayers, such as two, three, five, six, eight, or more sub-layers. In one embodiment, the sub-layers are not dried or are only partially dried prior to application of the subsequent sub-layer. As a result, partial mixing occurs at the boundaries between the sub-layers and/or diffusion of the charge transport component across the boundary between the sub-layers, and a more gradual variation, rather than step wise variation, in concentration of the charge transport component is achieved. For example, the solutions of different concentrations are deposited via separate slots in a slotted extrusion die to form sub-layers on under-layer 20.

If desired, the top charge transport layer in a multi-layered charge transport layer may also include, for example, additions of antioxidants, leveling agents, surfactants, wear resistant fillers such as dispersion of polytetrafluoroethylene (PTFE) particles and silica particles, light shock resisting or reducing agents, and the like, to impart further photo-electrical, mechanical, and copy print-out quality enhancement outcomes, particularly if no overcoat layer is used.

Additional aspects relate to the inclusion in the charge transport layer 22 of variable amounts of an antioxidant, such as a hindered phenol. Exemplary hindered phenols include octadecyl-3,5-di-tert-butyl-4-hydroxyhydrociannamate, available as Irganox I-1010 from Ciba Specialty Chemicals. The hindered phenol may be present at about 10 weight percent based on the concentration of the charge transport component. The hindered phenol concentration may be is tailored to produce a continuum of varying concentration of the antioxidant in reversal to that of the charge transport component for improved electrical stability and minimization of LCM impact.

Additional aspects relate to inclusion in the upper layer of the charge transport layer or to an overcoat layer 24 of nano particles as a dispersion, such as silica, metal oxides, Acumist™ (waxy polyethylene particles), PTFE, and the like. The nanoparticles may be used to enhance the lubricity and wear resistance of the charge transport layer 22. The particle dispersion concentrated in the top vicinity of the upper region of charge transport layer 22 can be up to about 10 weight percent of the weight of the top region or one tenth thickness of the charge transport layer 22 to provide optimum wear resistance without causing a deleterious impact on the electrical properties of the fabricated imaging member.

The charge transport layer 22 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 22 to the charge generator layer 18 is maintained from about 2:1 to about 200:1 and in some instances as great as about 400:1.

In one specific embodiment, the charge transport layer 22 is a solid solution including a charge transport component, such as m-TBD, molecularly dissolved in a polycarbonate binder, the binder being either a poly(4,4'-isopropylidene diphenyl carbonate) or a poly(4,4'-diphenyl-1,1'-cyclohexane carbonate). The charge transport layer may have a Young's Modulus in the range of from about $2.5\times10^5$ psi ($1.7\times10^4$ Kg/cm$^2$) to about $4.5\times10^5$ psi ($3.2\times10^4$ Kg/cm$^2$) and a thermal contraction coefficient of between about $6\times10^{-5}$/° C. and about $8\times10^{-5}$/° C.

Where an overcoat layer 24 is employed; it may comprise a similar resin used for the charge transport layer or a different resin and be from about 1 to about 2 microns in thickness.

Since the charge transport layer 22 can have a substantial thermal contraction mismatch compared to that of the substrate support 10, the prepared flexible electrophotographic imaging member may exhibit spontaneous upward curling due to the result of larger dimensional contraction in the charge transport layer 20 than the substrate support 10, as the imaging member cools down to room ambient temperature after the heating/drying processes of the applied wet charge transport layer coating. An anti-curl back coating 28 can be applied to the back side of the substrate support 10 (which is the side opposite the side bearing the electrically active coating layers) in order to render flatness.

The anti-curl back coating 28 may include any suitable organic or inorganic film forming polymers that are electrically insulating or slightly semi-conductive. The anti-curl back coating 28 used has a thermal contraction coefficient value substantially greater than that of the substrate support 10 used in the imaging member over a temperature range employed during imaging member fabrication layer coating and drying processes (typically between about 20° C. and about 130° C.). To yield the designed imaging member flatness outcome, the applied anti-curl back coating has a thermal contraction coefficient of at least about 1.5 times greater than that of the substrate support to be considered satisfactory; that is a value of at least approximately $1\times10^{-5}$/° C. greater than the substrate support, which typically has a substrate support thermal contraction coefficient of about $2\times10^{-5}$/° C. However, an anti-curl back coating with a thermal contraction coefficient at least about 2 times greater, equivalent to about $2\times10''^{5}$/° C. greater than that of the substrate support is appropriate to yield an effective anti-curling result. The applied anti-curl back coating 28 can be a film forming thermoplastic polymer, being optically transparent, with a Young's Modulus of at least about $2\times10^5$ psi ($1.4\times10^4$ Kg/cm$^2$), bonded to the substrate support to give at least about 15 gms/cm of 180° peel strength. The anti-curl back coating 28 may be from about 7 to about 20 weight percent based on the total weight of the imaging member, which may correspond to from about 7 to about 20 micrometers in dry coating thickness. The selected anti-curl back coating is readily applied by dissolving a suitable film forming polymer in any convenient organic solvent.

Exemplary film forming thermoplastic polymers suitable for use in the anti-curl back coating include polycarbonates, polystyrenes, polyesters, polyamides, polyurethanes, polyarylethers, polyarylsulfones, polyarylate, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, combinations thereof, and the like. These polymers may be block, random or alternating copolymers. Molecular weights can vary from about 20,000 to about 150,000. Suitable polycarbonates include bisphenol A polycarbonate materials, such as poly(4,4'-isopropylidene-diphenylene carbonate) having a molecular weight of from about 35,000 to about 40,000, available as Lexan 145™ from General Electric Company and poly(4,4'-isopropylidene-diphenylene carbonate) having a molecular weight of from about 40,000 to about 45,000, available as Lexan 141™ also from the General Electric Company. A bisphenol A polycarbonate resin having a molecular weight of from about 50,000 to about 120,000, is available as Makrolon™ from Farbenfabricken Bayer A.G. A lower molecular weight bisphenol A polycarbonate resin having a molecular weight of from about 20,000 to about 50,000 is available as Merlon™ from Mobay Chemical Company. Another suitable polycarbonate is poly(4,4-diphenyl-1,1'-cyclohexene carbonate), which is a film forming thermoplastic polymer comprising a structurally modified from bisphenol A polycarbonate which is commercially available from Mitsubishi Chemicals. All of these polycarbonates have a Tg of between about 145° C. and about 165° C. and with a thermal contraction coefficient ranging from about $6.0\times10^{-5}$/° C. to about $7.0\times10^{-5}$/° C.

Furthermore, suitable film forming thermoplastic polymers for the anti-curl back coating 28, if desired, may include the same binder polymers used in the charge transport layer 22. The anti-curl back coating formulation may include a small quantity of a saturated copolyester adhesion promoter to enhance its adhesion bond strength to the substrate support. Typical copolyester adhesion promoters are Vitel™ polyesters from Goodyear Rubber and Tire Company, Mor-Ester™ polyesters from Morton Chemicals, Eastar PETG™ polyesters from Eastman Chemicals, and the like. To impart optimum wear resistance as well as maintaining the coating layer optical clarity, the anti-curl layer may further incorporate in its material matrix, about 5 to about 30 weight percent filler dispersion of silica particles, Teflon particles, $PVF_2$ particles, stearate particles, aluminum oxide particles, titanium dioxide particles or a particle blend dispersion of Teflon™ and any of these inorganic particles. Suitable particles used for dispersion in the anti-curl back coating include particles having a size of between about 0.05 and about 0.22 micrometers, and more specifically between about 0.18 and about 0.20 micrometers.

In one embodiment, the anti-curl back coating 28 is optically transparent. The term optically transparent is defined herein as the capability of the anti-curl back coating to transmit at least about 98 percent of an incident light energy through the coating. The anti-curl back coating of this embodiment includes a film forming thermoplastic polymer and may have a glass transition temperature (Tg) value of at least about 75° C., a thermal contraction coefficient value of at least about 1.5 times greater than the thermal contraction coefficient value of the substrate support, a Young's Modulus of at least about $2\times10^5$ p.s.i, and adheres well over the supporting substrate to give a 180° peel strength value of at least about 15 g/cm.

In another embodiment, an imaging member may comprise, instead of an overcoat layer, a second layer consisting essentially of a film forming polymer binder coated over the charge transport layer. For example, with reference to FIG. 2, an imaging member may comprise an optional support substrate 50, an optional conductive surface layer or layers 52, an optional hole blocking layer 54, an optional adhesive layer 56, a charge generating layer 58, an under-layer 60, and a charge transport layer 62. These layers may have configurations and comprise materials as similar to those previously described herein with reference to comparable layers in the imaging member in FIG. 1. In FIG. 2, the imaging member further includes a layer 64 that, similar to the under-layer, such as under-layer 20 or 60, consists essentially of a film forming polymeric binder. Thus, the charge transport layer 62 is sandwiched between two film forming polymeric binder layers. The layer 64 is similar to under-layer 60 (or 20) in that it may consist essentially of a non-conductive polymer binder, a conductive polymer binder, and mixtures thereof. The layer 64 may be formed from any material as previously described with reference to the under-layer. In one embodiment, layer 64 may be formed from a composition different than that of under-layer 60. In another embodiment, layer 64 has the same make-up or composition as the under-layer 60.

The multilayered, flexible electrophotographic imaging member web stocks having an under-layer and charge transport layer fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

The prepared flexible imaging belt may thereafter be employed in any suitable and conventional electrophotographic imaging process which utilizes uniform charging prior to imagewise exposure to activating electromagnetic radiation, When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The development will further be illustrated in the following non-limiting examples, it being understood that these examples are intended to be illustrative only and that the disclosure is not intended to be limited to the materials, conditions, process parameters and the like recited herein. All proportions are by weight unless otherwise indicated.

EXAMPLES

In the following Examples, imaging members with a single charge transport layer were prepared to demonstrate the reduction in CDS by employing an under-layer adjacent the charge generation layer and intermediate the charge generation layer and the charge transport layer. It will be appreciated that these imaging members can be prepared with one, two, three or more transport layers or with gradient layers to provide a peak concentration intermediate the surface contacting the charge generation layer and the upper surface of the charge transport layer.

An imaging member was prepared by providing a 0.02 micrometer thick titanium layer coated on a biaxially oriented polyethylene naphthalate substrate (Kaledex™ 2000) having a thickness of 3.5 mils (0.09 millimeters). Applied thereon with a gravure applicator, was a solution containing 50 grams 3-amino-propyltriethoxysilane, 41.2 grams water, 15 grams acetic acid, 684.3 grams of 200 proof denatured alcohol and 200 grams heptane. This layer was then dried for about 2 minutes at 120° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of polyarylate adhesive (Ardel™ D100 available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 Angstroms.

A photogenerating layer dispersion was prepared by introducing 0.45 grams of Lupilon200™ (PC-Z 200) available from Mitsubishi Gas Chemical Corp and 50 ml of tetrahydrofuran into a 100 gm glass bottle. To this solution was added 2.4 grams of hydroxygallium phthalocyanine and 300 grams of ⅛ inch (3.2 millimeter) diameter stainless steel shot. This mixture was then placed on a ball mill for 8 hours. Subsequently, 2.25 grams of PC-Z 200 was dissolved in 46.1 gm of tetrahydrofuran, and added to this OHGaPc slurry. This slurry was then placed on a shaker for 10 minutes. The resulting slurry was, thereafter, applied to the adhesive interface with a Bird applicator to form a charge generation layer having a wet thickness of 0.25 mil (about 6 microns). However, a strip about 10 mm wide along one edge of the substrate web bearing the blocking layer and the adhesive layer, was deliberately left uncoated without any photogenerating layer material, to facilitate adequate electrical contact by the ground strip layer that was to be applied later. The charge generation layer was dried at 120° C. for 1 minute in a forced air oven to form a dry charge generation layer having a thickness of 0.4 micrometers.

This photogenerator layer was overcoated with a barrier layer. A polymer binder composition was dissolved in methylene chloride and applied on the photo generating layer using a Bird applicator to form a coating. The details regarding the specific polymer binder(s) used and the thickness of the barrier layer are set forth in the specific numbered examples.

This barrier layer was overcoated with a charge transport layer. The charge transport layer was prepared by introducing into an amber glass bottle in a weight ratio of 50:50 N,N'-diphenyl-N,N'-bis(3-methylphenyl)-biphenyl-4,4-diamine and Makrolon™ 5705. The resulting mixture was dissolved in methylene chloride to form a solution containing 15 percent by weight solids. This solution was applied on the photogenerator layer using a Bird applicator to form a coating which upon drying had a thickness of 29 microns. During this coating process the humidity was equal to or less than 15 percent.

Control 1

The layer applied over the photogenerating layer was a 50:50 mixture of N,N'-diphenyl-N,N'-bis(3-methylpnenyl)-1,1'-biphenyl-4,4'-diamine (m-TBD) and Makrolon™ 5705. This mixture was dissolved in methylene chloride to form a solution that was applied on the photogenerating layer using a Bird applicator to form a coating having a dry thickness of 14.5 microns. During the coating process, the humidity was equal to or less than 15%.

Control 2

A layer was applied over the photogenerating layer as described with reference to Control 1, except that the layer was formed from a composition having a 35:65 weight ratio of m-TBD to Makrolon™.

Example 1

A barrier layer formed from a 100% by weight solution of Makrolon™ was coated over the photogenerating layer to form a coating having a (dry) thickness of 2.5 microns.

Example 2

A barrier layer was coated over the photogenerating layer from a solution comprising 100% by weight of Makrolon™ to form a barrier layer having a dry thickness of 5 microns.

Example 3

A barrier layer was coated over the photogenerating layer with a composition having 100% by weight Makrolon™ to form a coating having a dry thickness of 10 microns.

Example 4

A barrier layer was formed using a conductive polymer binder. The barrier layer was formed from a composition comprising 100% by weight polyvinyl carbazole to form a barrier layer having a thickness of 5 microns.

Example 5

A photoreceptor was prepared as in Example 1 except as follows:

1. Solution for Under-layer coating: Polystyrene 1.5 grams was mixed with TTA 0.4 gram, TAPC 0.4 gram and Ab-16 0.4 gram. This mixture was dissolved in 37.3 grams of solvent THF.

Photoreceptor Device Fabrication: On the belt photoreceptor with up to charge generating layer, the above solution was coated by #1 Bird bar, and dried at 120° C. for 5 minutes. This new under-layer was about 2.0 micron thick (Device 30072-03E). For comparison, a control photoreceptor, Device 30072-03C, was made.

4000 Scanning Test Data

| Samples | V0 | S | Vc | Vr | Vdepl | Vdd |
|---|---|---|---|---|---|---|
| 30072-03C | 797.374 | 342.960 | 169.498 | 35.612 | 15.59 | 38.77 |
| 30072-03E | 797.901 | 376.700 | 142.604 | 77.407 | 45.95 | 32.43 |

Example 6

The barrier layer was prepared by introducing into an amber glass bottle and a weight ratio of 40:60 N,N'-diphenyl-N,N'-bis(3-methylphenyl)-1,1'-biphenyl-4,4'-diamine and PCZ 400 (a polycarbonate resin) and 0.5% BHT. The mixture was dissolved in a mixture of THF and monochlorobenzene to form a solution. This solution was applied on the photogenerator layer using a Bird applicator to form a coating having a dry thickness of 2.5 microns.

Example 7

The barrier layer was prepared by introducing into an amber glass bottle and a weight ration of 10:30:60 N,N'-diphenyl-N,N'-bis(3-methylphenyl)-1,1'-biphenyl-4,4'-diamine and PCZ400 (a polycarbonate resin) and 8% PTFE. The mixture was dissolved in a mixture of THF and Toluene to form a solution. This solution was applied on the photogenerator layer using a Bird applicator to form a coating having a dry thickness of 5 microns.

Electrical Scanner

The flexible photoreceptor sheets prepared as described in Examples 1-7 and the controls tested for their xerographic sensitivity and cyclic stability in a scanner. In the scanner, each photoreceptor sheet to be evaluated was mounted on a cylindrical aluminum drum substrate, which was rotated on a shaft. The devices were charged by a corotron mounted along the periphery of the drum. The surface potential was measured as a function of time by capacitatively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential (Vddp) was measured by a first voltage probe. Further rotation lead to an exposure station, where the photoreceptor device was exposed to monochromatic radiation of a known intensity of 3.5 ergs/cm$^2$ to obtain Vbg. The devices were erased by a light source located at a position upstream of charging to obtain Vr. The measurements illustrated in Table 1 below include the charging of each photoconductor device in a constant current or voltage mode. The devices were charged to a negative polarity corona. The surface potential after exposure (Vbg) was measured by a second voltage probe. In the design, the exposure could be turned off in certain cycles. The voltage measured at the second probe is then Vddp. The voltage generally is higher at the charging station. The difference between the charged voltage at the charging station and the Vddp is dark decay. The devices were finally exposed to an erase lamp of appropriate intensity and any residual potential (Vr) was measured by a third voltage probe. After 10,000 charge-erase cycles, the Vbg was remeasured and the difference between Vbg for the first cycle and Vbg for cycle 10,000 (ΔVbg 10K) was computed.

Table 1 shows the composition of the charge transport layers after drying for the controls and the exemplary sheet configurations along with the measured electrical characteristics described above.

TABLE 1

| Example | Vbg (initial) 3.5 erg/cm$^2$; Vddp = 500 | Vbg (10k) 3.5 erg/cm$^2$; Vddp = 500 | Vresidual (300 erg/cm$^2$) | Dark Deray | Slope | Constant Current |
|---|---|---|---|---|---|---|
| Control 1 | 54 | 99 | 17 | −206 | 51 | 1113 |
| Control 2 | 76 | 128 | 37 | −148 | 52 | 1154 |
| 1 | 69 | 117 | 75 | −158 | 53 | 1142 |
| 2 | 83 | 135 | 124 | −175 | 55 | 1201 |
| 3 | 132 | 202 | 116 | −189 | 59 | 1321 |
| 6 | 67 | 126 | 31 | −116 | 53 | 1159 |
| 7 | 45 | 54 | 5 | 126 | 55 | 1175 |

The sheets thus formed were tested with a floating probe scanner (FPS scanner) for CDS in a manner similar to that described in U.S. Pat. Nos. 6,008,653 and 6,119,536 incorporated herein by reference. The 23 cm wide and 28 cm long sheets of all the samples were cut and mounted on a drum of the FPS scanner one at a time. The drum was rotated continuously and underwent a sequence of charging under a scorotron to about 700 volts. Then measurements of micro defects were made. These consisted of high resolution voltage measurements of from about 50 to about 100 micron resolution by an aerodynamically floating probe which was capacitively coupled to the photoreceptor charged surface. The probe was maintained at a constant distance of 50 microns during the entire scan of the sample surface. After this, the photoreceptor was discharged by an erase lamp before the next cycle started. In each cycle the drum was moved translationally in small steps of from about 25 to about 50 microns. The floating probe scanner then counted the CDS's over an area of about 100 to about 150 cm$^2$ and provided an average value/cm$^2$. Table 2 shows the results obtained with the floating probe scanner.

TABLE 2

| Example | CDS count/cm$^2$ |
|---|---|
| Control 1 | 32.9 |
| Control 2 | ? |
| 1 | 2.8 |
| 2 | 5.0 |
| 3 | 9.0 |
| 5 | 10 |
| 6 | 10.9 |
| 7 | 11.1 |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member comprising:

an optional substrate;

a charge generating layer;

a charge transport layer disposed about the charge generating layer; and a barrier layer disposed intermediate the charge generating layer and the charge transport layer, wherein the barrier layer comprises a film forming polymeric binder material selected from a conductive binder, a non-conductive binder, and mixtures thereof.

2. The imaging member according to claim 1, wherein the barrier layer comprises a non-conductive polymer binder.

3. The imaging member according to claim 1, wherein the barrier layer comprises a non-conductive polymer binder selected from the group consisting of a polyester, a polycarbonate, a polyarylate, a polyacrylate, a polyether, a polysulfane, a polyvinyl butyral, a polystyrene, a polyvinyl formal, and mixtures thereof.

4. The imaging member according to claim 1, wherein the barrier layer comprises a conductive polymer binder.

5. The imaging member according to claim 4, wherein the conductive polymer binder is a carbazole polymer.

6. The imaging member according to claim 4, wherein the conductive polymer includes a polycarbazole of the formula

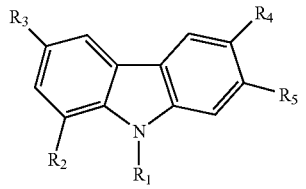

$R_1$ is selected from

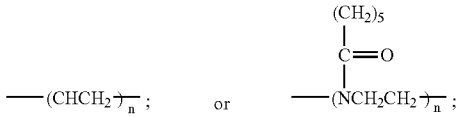

and $R_{2-5}$ are independently selected from hydrogen, alkyl, substituted alkyl, alkoxy, and combinations thereof.

7. The imaging member according to claim 4, wherein the conductive polymer binder includes a polyvinyl carbazole.

8. The imaging member according to claim 4, wherein the conductive polymer includes a polycarbazole selected from the group consisting of

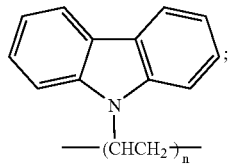

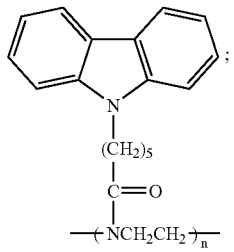

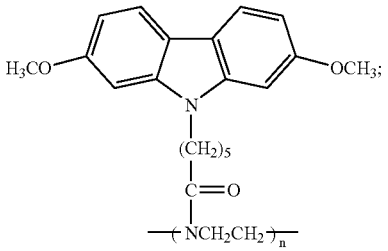

-continued

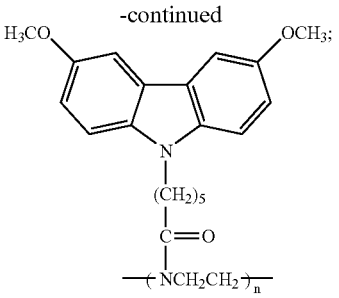

and mixtures thereof.

9. The imaging member according to claim 4, wherein the conductive polymer binder includes a benzidene based polymer.

10. The imaging member according to claim 9, wherein the benzidene based polymer is selected from poly[oxydecamethyleneoxy-N,N'-diphenyl-N,N'bis(3-carbonylphenyl)benzidine], poly[oxymethyleneoxy-N,N'-diphenyl-N,N'-bis(4-carbonylphenyl)benzidine], and mixtures thereof.

11. The imaging member according to claim 1, wherein the barrier layer has thickness of from about 1 to about 15 μm.

12. An imaging member comprising:

an optional substrate;

a photogenerating layer;

a barrier layer disposed over the photogenerating layer; and a charge transport layer disposed over the barrier layer;

wherein the barrier layer comprises (i) a polymeric binder material selected from a conductive polymer binder, a non-conductive polymer binder, and mixtures thereof, and (ii) a charge transport material in an amount of from about 0 to about 40% by weight of the barrier layer.

13. The imaging member according to claim 12, wherein the barrier layer includes a charge transport material in an amount from about greater than 0% by weight to about 10% by weight.

14. An imaging member comprising:

an optional substrate;

a charge generating layer;

a first layer comprising a first film forming polymer binder selected from a non-conductive polymer binder, a conductive polymer binder, and mixtures thereof;

a charge transport layer; and a second layer comprising a second film forming polymer binder selected from a non-conductive polymer binder, a conductive polymer binder, and mixtures thereof;

wherein the first layer is disposed intermediate the charge generating layer and the charge transport layer, and the second layer is disposed over the charge transport layer.

15. The imaging member according to claim 14, wherein the first film forming polymer binder has a composition different than the second film forming polymer binder.

16. The imaging member according to claim 14, wherein the first and second film forming polymer binders have the same composition.

17. The imaging member according to claim 14, wherein the first and second film forming polymer binder include a non-conductive polymer binder.

18. The imaging member according to claim 14, wherein the first and second film forming polymer binder include a polycarbonate.

19. The imaging member according to claim 14, wherein the first and second film forming polymer binder include a conductive polymer binder.

20. The imaging member according to claim 14, wherein the first and second film forming polymer binder include a polycarbazole.

* * * * *